United States Patent [19]

Horncy et al.

[11] 4,397,583

[45] Aug. 9, 1983

[54] TUNNEL LININGS

[75] Inventors: Thomas E. Horncy, Kirby Muxloe; David R. Allum, Mansfield; Rupert J. S. McBean, Market Harborough, all of England

[73] Assignee: Charcon Tunnels Limited, Nottinghamshire, England

[21] Appl. No.: 210,792

[22] Filed: Nov. 26, 1980

Related U.S. Application Data

[63] Continuation-in-part of Ser. No. 165,394, Jul. 2, 1980, abandoned, which is a continuation of Ser. No. 932,216, Aug. 9, 1978, abandoned.

[30] Foreign Application Priority Data

Aug. 16, 1977 [GB] United Kingdom ..... 34416/77

[51] Int. Cl.[3] ..... E21D 11/08; E04C 1/00

[52] U.S. Cl. ..... 405/150; 52/583; 52/587

[58] Field of Search ..... 52/583, 587, 224, 227; 405/150–153

[56] References Cited

U.S. PATENT DOCUMENTS

| | | | |
|---|---|---|---|
| 794,063 | 7/1905 | West | 52/432 |
| 830,345 | 9/1906 | Mattson | 52/245 |
| 1,061,665 | 5/1913 | Easterday | 52/583 |
| 1,067,854 | 7/1913 | White | 52/583 |
| 1,094,080 | 4/1914 | Mayer | 52/583 |
| 1,208,983 | 12/1916 | Krebs | 52/245 |
| 1,370,415 | 3/1921 | Dale | 52/583 |
| 1,393,699 | 10/1921 | Purcell et al. | 52/583 |
| 2,229,779 | 1/1941 | Thomas | 52/583 |
| 2,508,409 | 5/1950 | Lord | 85/85 |
| 2,920,475 | 1/1960 | Graham | 52/587 |
| 3,394,522 | 7/1968 | Maurer | 52/583 |
| 3,557,402 | 1/1971 | Koehl | 85/8.3 |
| 3,832,817 | 9/1974 | Martens | 52/432 |

FOREIGN PATENT DOCUMENTS

| | | | |
|---|---|---|---|
| 55205 | 5/1951 | France | 52/583 |
| 1279157 | 11/1961 | France | 405/150 |
| 21447 | 10/1929 | Netherlands | 52/583 |
| 711449 | 6/1954 | United Kingdom | 52/227 |

*Primary Examiner*—James L. Ridgill, Jr.

*Attorney, Agent, or Firm*—Cushman, Darby & Cushman

[57] ABSTRACT

A tunnel lining comprises a plurality of arcuate concrete tunnel lining segments. Each segment has at each circumferential end thereof two semi-cylindrical grooves spaced apart along the end and extending partway across the end. One of the grooves has two semi-circular hoops projecting from the end of the segment across the groove at spaced postions along the groove and the other groove has a single semi-circular hoop projecting from the end of the segment across the groove. Two segment ends are located together with respective hoops in alignment and tapered pins or other fastening devices are driven into the aligned hoops to draw and hold the segment ends together in compression.

4 Claims, 13 Drawing Figures

FIG 5
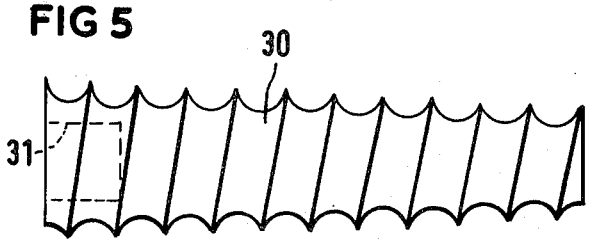
FIG 6A
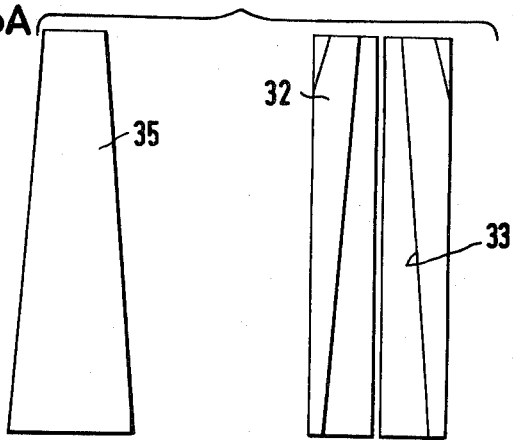
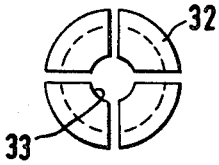
FIG 6B
FIG. 7.
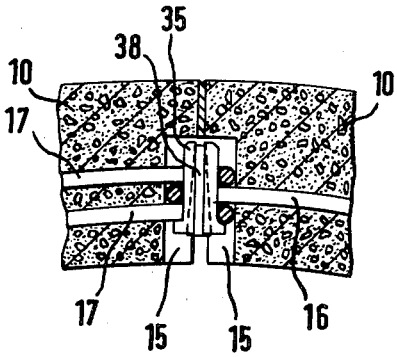

TUNNEL LININGS

BACKGROUND OF THE INVENTION

1. Field of the Invention

This invention relates to tunnel linings and in particular to tunnel linings comprising rings of arcuate tunnel lining segments formed in cast material of high compressive strength. This application is a continuation-in-part of U.S. patent application Ser. No. 165,394 filed July 2, 1980 (now abandoned), itself a continuation of U.S. patent application Ser. No. 932,216 filed Aug. 9, 1978 (now abandoned).

2. Description of the Prior Art

Concrete wall segments such as arcuate tunnel lining segments are commonly provided with integral flanges having cast in holes to receive bolts for securing pairs of segments together. Such an arrangement is used extensively for arcuate concrete tunnel lining segments. The circumferential ends of each segment have inwardly extending integral flanges with cast in bolt holes for bolting segments together in a ring. The bolt holes have to be cast over size to provide adequate tolerances for the bolts and the resulting play between the bolts and their oversize holes which normally arises makes it very difficult to get an arcuate face-to-face alignment between adjacent segments in the difficult working conditions of a tunnel. As a result, the tunnel lining inevitably has a large proportion of segments which are slightly out of alignment with each other. High stress concentrations arise at the junctions of the flanges and the segments may fracture at these locations when subjected to heavy loads. The flanges can fail simply when the bolts are tightened sufficiently to render the joint waterproof. Where a smooth internal surface is required for the tunnel it is necessary to lay a second inner lining to fill the voids between flanges and this involves extra materials and labour.

U.K. Pat. No. 1,292,638 shows a construction of tunnel lining segment which provides a smooth internal surface without the need of a secondary lining. In the latter specification, the segments have through bores and are connected together by tie rods located in the bores with coupling sleeves screwed into the tie rods of adjacent segments to secure them together. The erection and securing of such segments is however a more difficult operation then the simple bolted connection of the first arrangement described above and, as with the bolted connection, a variety of different components have to be provided which is unsatisfactory in tunnel work.

U.S. Pat. No. 794,063 of C. L. West discloses a monument mounted on a base, the base having two upstanding eyes 9 formed at the ends of twisted wires located in a lead filled recess in the base. The eyes project above the base to receive between them a corresponding eye formed at the end of a twisted wire located in a lead filled recess in the underside of the monument. A tapering screw key is passed through a channel in the underside of the monument and through the overlapping eyes to draw the members of the monument together. It is clear that no significant load could be imposed on the overlapping eyes by the tapered screw because the eyes would simply pull out of the lead or the lead sockets would be pulled out of the monument and base and also the narrow screw would simply bend. Although the arrangement is intended to assist in preventing the ingress of moisture between the monument and the base it would seem that the arrangement could not provide any significantly greater clamping force between the monument and base than would arise from the weight of the monument on the base alone.

U.S. Pat. No. 2,920,475 of Graham discloses building panels having cast in members extending through the panels provided with coupling devices at the ends of the members. The coupling devices attach the panel to adjacent panels with gaps between the panels which are subsequently filled with grout or mortar. The coupling devices are not suitable for holding the edges of the panels together in compression to avoid the need for filling between the panels.

U.S. Pat. No. 1,393,699 of C. H. Purcell et al. shows a pavement construction in which grooves are provided along the edges of the pavement members with hoops bridging the grooves to enable adjacent pavement elements to be secured together. The construction is such that, when two elements are secured together, there is a gap between them which has to be filled in with grout and the arrangement of hoops described is clearly not capable of holding the adjacent edges of two members together in compression.

U.S. Pat. No. 3,832,817 of Matens discloses panels having eye loops formed in the edges thereof to be joined and overlap one another when the panels are placed in position an expandable sleeve is inserted through the overlapping loops and a wedge pin is driven into the sleeve thus expanding the sleeve and drawing the panels into exact position relative to one another. The joint is then grouted to seal the junction between the panels. Thus the jointing system described is capable of correctly aligning the panels but is not capable of holding the panels together with their abutting edges in compression to provide a seal that does not require grouting.

It is an object of the present invention to provide a joint betwen adjacent ends of arcuate concrete tunnel lining segments which enables a segment to be locked together end-to-end from within the tunnel lining with a compressive force between the adjacent ends of the segments sufficient to avoid the need for subsequent grouting or other waterproofing of the joint.

SUMMARY OF THE INVENTION

The invention provides a tunnel lining comprising a plurality of arcuate tunnel lining segments formed in a cast material of high compressive strength, each segment having joining means at each longitudinal end thereof for joining the segment ends to the corresponding ends of similar segments, the joining means at each end of the segment comprising at least two semi-cylindrical grooves formed in the segment end at spaced locations along the end and extending only part way across the end from the inner side of the segment to stop short of the outer side of the segment, part circular tensile hoops ptojecting from the end of the segment and bridging the grooves for overlapping with corresponding hoops on the adjacent segment end, each hoop having a pair of legs extending into and anchored in the cast segment to resist tensile forces imposed on the hoops, the axes of the hoops lying in a plane containing the respective segment end and fastening means engaging in the overlapping hoops of the adjacent segment ends and exerting a pulling force on the hoops to hold the segment ends together in compression.

Because the hoops are cast into the concrete the joint can be designed to take full advantage of both the permissible tensile stress which the steel can withstand and the compressive strength of the concrete. Thus the joint will thus withstand any tensile force up to the permissible tensile strength of the hoops and any compression up to the permissible compressive strength of the concrete.

BRIEF DESCRIPTION OF THE DRAWINGS

FIGS. 5 and 6 show further forms of fastening device for connecting the segments together;

FIGS. 7 and 8 show a further form of joint, and

DESCRIPTION OF THE PREFERRED EMBODIMENTS

Figure 1:
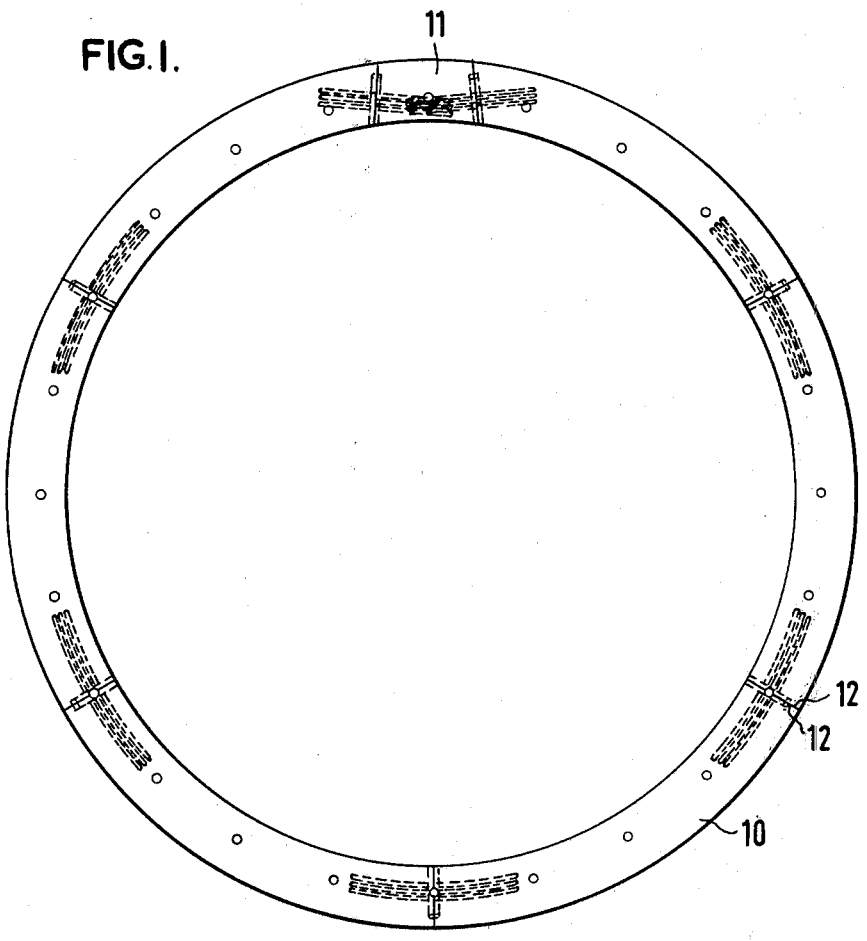
FIG. 1 is an end view of a ring or arcuate concrete tunnel lining segment according to the invention.

Referring firstly to FIG. 1 of the drawings, there is shown a ring of pre-cast concrete tunnel lining segments 10, joined at the top of the ring by a key segment 11.

Figure 2:
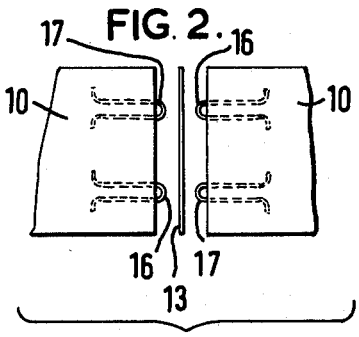
FIG. 2 is a plan view of part of a joint between two adjacent segments with the segments separated.

The segments have axially extending end faces 12 which are secured together and to the key segment 11 by similar joints which will now be described with reference to FIGS. 2 and 3 of the drawings.

Each pair of adjacent end faces 12 has a semi-compressible membrane such as "Bitumastic" 13 between the end faces and two joints indicated generally at 14 at spaced locations across the axially extending end faces 12.

Each joint 14 comprises opposing part cylindrical grooves 15 extending down the respective end faces 12 from the inner sides of the segments towards but stopping short of the outer sides of the segments. Mid-way down the groove 15 is one of the faces 12*a* there is a projecting steel hoop 16 which bridges the grooves 15, the hoop having legs 17 embedded in the segment. The opposing end face 12*b* has two similar hoops 17 spaced apart along the groove to receive between them the hoop 16. The first end face 12*a* has slots 18 spaced above and below the hoop 16 to receive the hoops 17 and, similarly, the other end face 12*b* has a slot 19 between the hoops 17 to receive the hoop 16.

The joint is completed by a steel pin 20 having a tapered end 21 and a head 22. The pin is driven through an axial bore formed by the grooves 15 through the over-lapping hoops 16, 17 from the inside of the segments. The inner surfaces of the segments are formed with recesses 23 around the ends of the grooves 15 to receive the head 22 of the pin.

The other joint 14 between the end faces of the segments is generally similar to that described above except that the pair of hoops 17 and single hoop 16 are reversed so that the pair of hoops 17 are formed on the one axial end face and the single hoop 16 is provided on the other axial end face.

Figure 3:
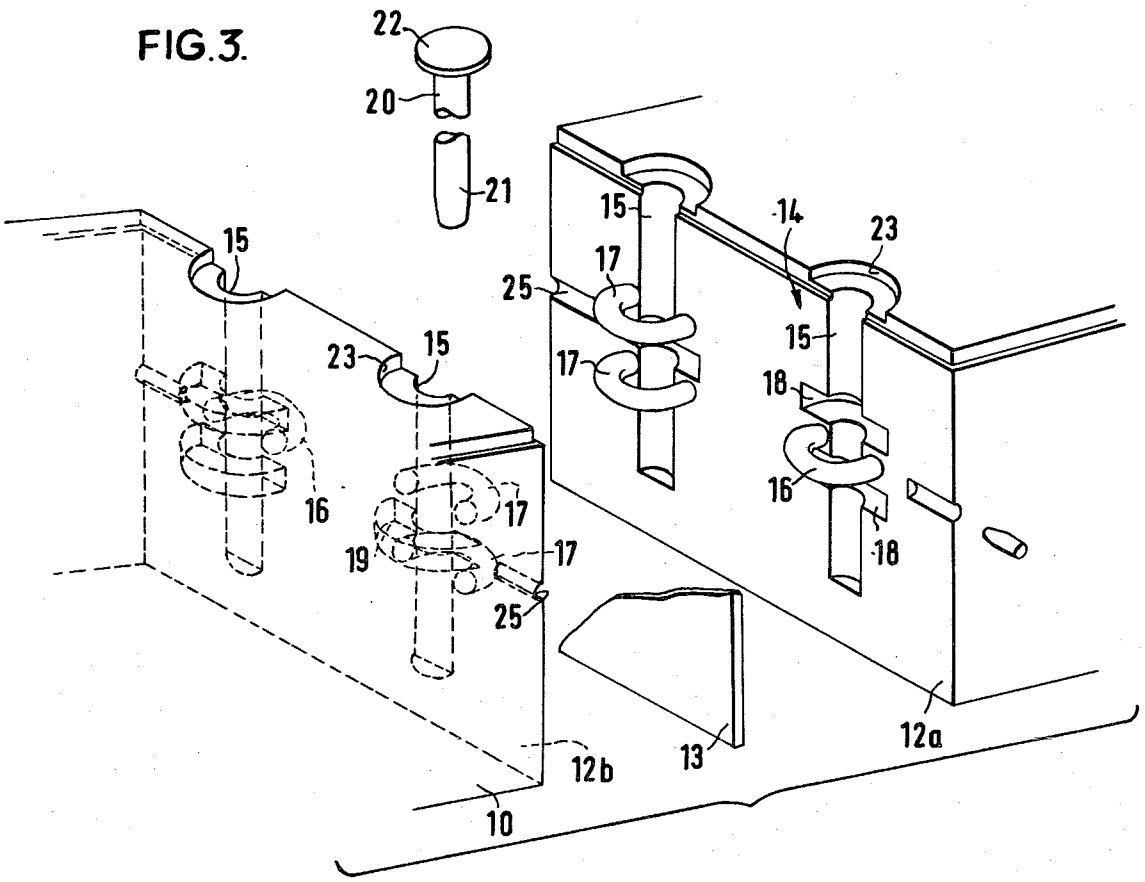
FIG. 3 is a perspective view of part of a joint between adjacent segments with the segments separated.
Figure 4:
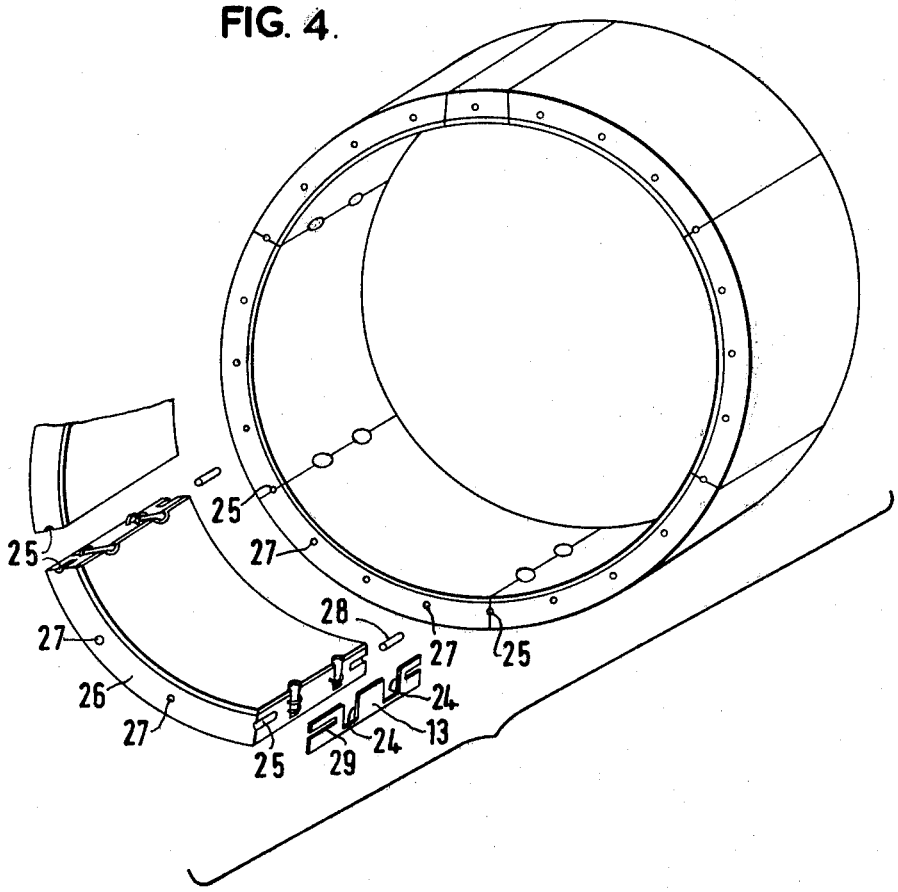
FIG. 4 is a perspective view of the ring shown in FIG. 1 with part of an additional ring shown in an exploded view.

As best seen in FIG. 3 of the drawings, the gasket 13 has cut outs 24 in the regions of the two joints 14.

In assembling a pair of segments, the two segments lined up and two pins 20 are driven into the openings formed by the grooves 15 of each joint The arrangement is such that the inter-engaging of the pins with the hoops 16, 17 draws the ends 12 of the segments together compressing the gasket 13 between the ends. The pins 20 can simply be hammered into place or suitable pneumatic tools can be used for driving the pins into place. The joint described above applied to the connection between two segments 10 and a similar joint is provided between the uppermost segments 10 and the key segment 11. Once a ring of segments has been completed, the pins may, in certain circumstances, be extracted and the resulting voids filled with a cementitious material. Normally, however, the pins are left in situ to maintain the joints between the segments in compression.

The axial end faces of the segments also have part-cylindrical grooves 25 extending part-way into the faces from the circumferential sides 26 of the segments. Each circumferential side face 26 also has three bores 27 extending into the segment, the bores 27 being equispaced from each other and from the grooves 25. The part-cylindrical grooves 25 between adjacent segments and the bores 27 are intended to receive steel dowels 28 for locating the newly erected ring of segments circumferentially with respect to the previously erected ring of segments. When a ring of segments has been completed and the next ring is to be started, one dowel 28 is placed in bore 25 or 27 in the previously erected ring where the end of the first segment of the newly erected ring is required to be located. The ends of the segment of the new ring can be in line with the ends of a segment in the previously erected ring in which case the dowels are located in the bores 25 or may be staggered with respect to the ends of the previously erected segment in which case the dowels are located in bores 27. When the first segment has been erected, the further dowel 28 is inserted in the appropriate bore around the previously erected ring and the next segment is erected and so on until the ring is completed. The gaskets 13 provide between adjacent axial ends of the segments have cutouts 29 to line up with the grooves 25 and permit insertion of the dowels 28.

The number of bores 27 and the positions of the bores may be varied from that described above to suit the stagger required between adjacent segments. Thus one or more bores 27 may be provided in each segment as required. Further, where no stagger is required between adjacent segments, the bores 27 may be omitted altogether.

The segments 10 may be parallel sided or one or both circumferential sides of the segments may be tapered towards the other side. The use of tapering segments permits the ring to be rotated either in a horizontal or vertical direction to correct for any deviation in the required path of the tunnel or to take the tunnel around a bend or up or down a gradient.

As can be seen in FIG. 1 of the drawings, the pitch between bores 25 and 27 is such that there is a bore 27 at the centre of the key segment but no bores are provided at the joints between the key segment and its adjacent segment.

FIG. 5 to which reference is now made show alternative fastening devices to the pin 20 to be driven through the hoops of the segments to make the joints between the segments. FIG. 5 shows a coarse threaded taper screw 30 having a square section socket 31 at one end to receive a tool for driving the screw into the aligned hoops of two adjacent segments. In this case the loops are inclined or twisted slightly as viewed looking end on to the segment to suit the lead angle of the thread of the screw 30 to be driven through the loops.

FIGS. 6A and 6B show a cylindrical sleeve 32 split into four sectors and having a tapered bore 33 into which a solid tapered pin 34 is driven to expand the sleeve.

Figure 8:
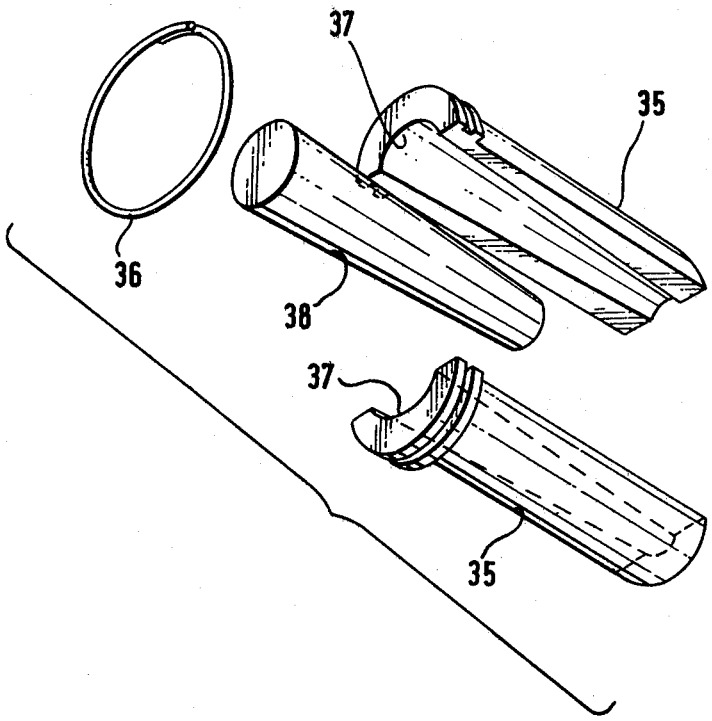

FIG. 7 shows a modified form of segment in which the grooves 15 to receive the fastening members 20 are formed with a larger diameter than the tensile hoops 17 and the hoops therefor project from the surfaces of the grooves across the grooves rather than from the end face of the segment on either side of the grooves. The slots 18, 19 of the original embodiment are omitted since the groove in one segment will wholly accommodate the projecting hoops from the other segment without the need for slots. A modified form of fastening device is also provided as best seen in FIG. 8 and comprises a two-part split sleeve 35 held together by a spring ring 36 and having a tapered bore 37 to receive a tapered ring 38. In the drawing the components are shown in 'exploded' condition in order to illustrate the construction clearly. The assembled device is inserted in the overlapping hoops with the split sleeve 35 contracted, that is with the pin 38 only partially inserted between the sleeves, and the pin is then driven fully between the sleeve using a hammer or pneumatic tool and the resulting expansion of the sleeves draws the overlapping hoops apart to put the abutting end faces of the segments in compression in a similar manner to that previously described.

Figure 10:
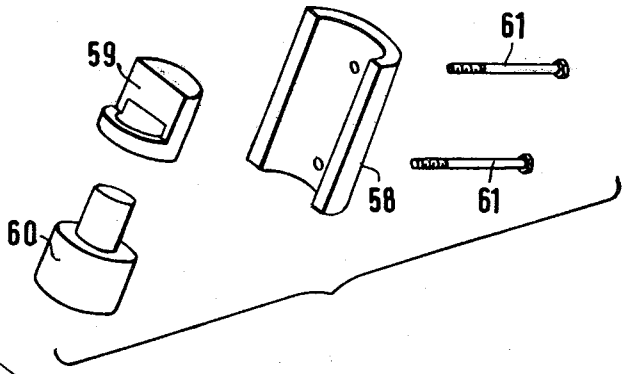
FIGS. 9 to 12 show mould parts for moulding the segments.
Figure 9:
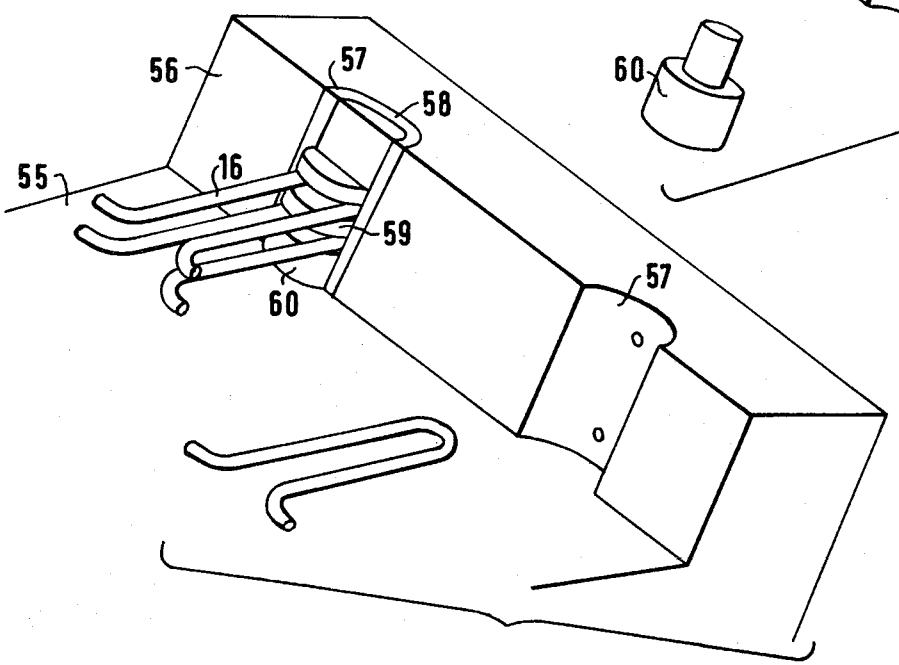

FIG. 9 of the drawings shows part of a mould 55 for moulding the arcuare segment as described in FIGS. 1 to 4. One end 56 of the mould which forms the end 12 of the segment can be seen which is formed with two semi-cylindrical recesses 57 to receive two semi-cylindrical liners 58 one of which is shown in FIG. 10. Shaped die parts 59 and 60 are located in the liner and hold the hoops 16 in place during the moulding operation and provide the cavities for the grooves 18, 25 as required. The die parts 59, 60 and the semi-cylindrical liner 58 are held in place by studs 61 extending through the end wall 56 of the die and the liner 58 and screwed into the die parts 59 and 60 to support the die parts at the required positions. When the moulding operation has been completed, the studs 61 are removed and this enables the moulded segment to be lifted out of the die drawing with it the die parts 59 and 60 which can be broken away separately. This arrangement enables the mould to be provided with side faces for accurately casting the side faces of the segment so that all the important faces of the segment, that is the inner surface, the side and end faces are formed in the mould leaving only the outer surface to be shaped by trowelling.

FIG. 10 of the drawings illustrates hoops 16 for casting into a segment and in such a case it would usually benecessary to cast separate reinforcement into the segment.

Figure 11:
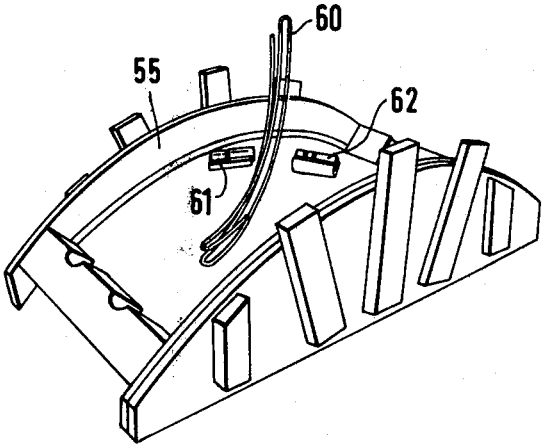
Figure 12:
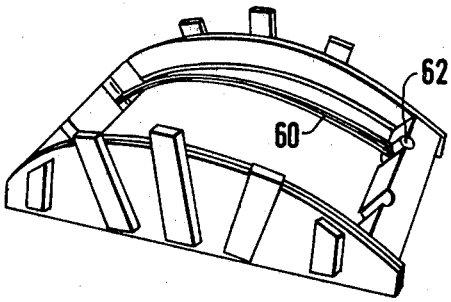

FIGS. 11 and 12 illustrate an alternative to the hoops and separate reinforcement in which two hoops for projecting at either end of the segment and the reinforcement for the segment are combined in a single bent rod 60 in the shape of a paper clip. The two loops at one end of the bent rod are made of equal length to provide two hoops at one end of the segment and a single hoop is provided at the other end of the segment. The shaped die pieces 61 and 62 used with this arrangement are illustrated and are held in place by studs during the moulding operation similar to those used with the mould shown in FIG. 9.

It will be understood that many modifications may be made to the above described embodiments without departing from the scope of the invention. For example the Bitumastic gasket disposed between the adjacent segments may be replaced by a suitable gasket material applied to the end faces of the segments. For example an epoxy based material can be used. Also, in some cases, the plain ends of the segments can be abutted without any form of gasket or end face coating particularly where ingress of water through the joint is not a problem where the joints are to be grouted in a conventional manner or where the connecting device itself holds the end faces of the segment together with sufficient compressive force to render any gasket or equivalent inessential.

The arrangements described above provide methods of jointing together concrete segments particularly quickly and no special tools are required other than a hammer or spanner to suit the particular fastening device being used. The method is thus particularly useful in confined and difficult working conditions such as those encountered in tunnels. In the case of tunnel linings, the joints are substantially concealed within the thickness of the segments and so a smooth internal surface is produced. Thus the need for a secondary lining as required in the case of flanged segments to provide a smooth internal surface is obviated and substantial costs savings result from the saving of the material of the secondary lining and also the labour in erecting the secondary lining. Also the smooth internal surface provided by the lining makes the tunnel easy to clean out when erection has been completed. Furthermore the jointing arrangements between segments enable a tunnel lining to be erected in any ground conditions (whatever the degree of instability) in which a tunnel can be excavated.

The engagement of the fastening devices in the loops between adjacent segments accurately aligns one segment with the next to avoid or minimise "lipping" between adjacent segments both around the along the tunnel and the tunnel lining is built with a much truer circularity than is the case with conventional bolted linings. The latter features is of particular advantage in that it avoids the need to use extra apparatus for forcing the rings of segments into true circularity.

The tensile loops transfer the stresses back into the body of the segments and loads are distributed across the whole width of the segment. In the case where the tensile loops are formed integrally with the segment reinforcement, the reinforcement and loops form a continuous hoop for withstanding stress extending around the whole ring. The latter arrangement is of particular value for tunnels required to conduct a fluid under pressure.

We claim:

1. A tunnel lining comprising a plurality of arcuate tunnel lining segments formed in a cast material of high-compressive strength, each segment having joining means at each longitudinal end thereof for joining the segment ends to the corresponding ends of similar segments to form a ring, the joining means comprising a semi-cylindrical groove formed in the segment end and part circular tensile hoops projecting from the segment end to bridge the groove and overlap with corresponding hoops on the adjacent segment end and fastening means for engaging in the overlapping hoops between the segment ends to mate together and to hold the segment ends together; the improvement comprising at each end of each segment at least two semi-cylindrical grooves at spaced locations along the end and extending across the segment end from the inner side of the segment and stopping short of the outside of the segment; for at least one of the grooves a pair of part circular tensile hoops projecting from the segment end and bridging the groove to receive a single hoop on the adjacent segment end between said pair of hoops; and adjustable permanent elongate fastening devices which have a tapered length longer than the spacing between said two hoops to be driven into the overlapping hoops between the segment ends to draw the segment ends together and to apply a compressive force and control rotation between the segment ends which compressive force and degree of rotation can be varied in accordance with the extent to which the fastening devices are driven into the hoops to provide a sealed permanent connection, with controlled rotation, between the segment ends which can transmit shear tension, compression and bending moment through the ring of segments and thereby forming a monolithic structure capable of supporting both internal and external pressures.

2. A tunnel lining as claimed in claim 1 wherein the fastening devices each comprise a split sleeve to engage in the overlapping hoops and having a tapered bore and a tapered pin to engage in the bore and expand the sleeve to act on the hoops in a direction to draw the segment ends together in compression.

3. A tunnel lining as claimed in claim 1 wherein each fastening device comprises a tapered element having a coarse screw thread and the part circular hoops are angled to engage the thread of the element.

4. A ring-shaped tunnel lining comprising a plurality of arcuate tunnel lining segments formed in a cast material of high compressive strength, each segment having opposite end faces in abutment with an end face of an adjacent segment, each end face of each segment having at least first and second spaced-apart parallel grooves therein, extending in the thickness dimension of the segment from the inner side of the segment and stopping short of the outside of the segment; associated with one of the grooves in each end face a pair of spaced-apart, part-circular hoops of high tensile strength material projecting from the respective end face and bridging the respective groove; associated with the other groove in each end face a single part-circular hoop of high strength material projecting from the respective end face and bridging the respective groove, each of said single hoops on one segment lying between and overlapping the hoops of a pair of hoops on an adjacent segment, and each of said hoops being received in a slot formed in the end face of the segment toward which the hoop projects; and elongate fastening devices having tapered lengths longer than the spacing between the hoops of each pair of hoops, said fastening devices having been driven from inside the segments through the overlapping hoops with said tapered lengths in contact with the overlapping hoops thereby drawing the segment ends together and applying and maintaining compressive force between the segment ends.

* * * * *